United States Patent [19]

Theurer et al.

[11] Patent Number: 4,606,273

[45] Date of Patent: Aug. 19, 1986

[54] RAILWAY CARRIAGE WITH SET-OFF APPARATUS

[75] Inventors: Josef Theurer, Vienna; Friedrich Oellerer, Linz, both of Austria

[73] Assignee: Franz Plasser Bahnbaumaschinen-Industriegesellschaft m.b.H., Vienna, Austria

[21] Appl. No.: 674,004

[22] Filed: Nov. 23, 1984

[30] Foreign Application Priority Data

Feb. 24, 1984 [AT] Austria ..... 619/84

[51] Int. Cl.[4] ..... B61K 5/00

[52] U.S. Cl. ..... 104/1 R; 104/273; 104/261; 105/7

[58] Field of Search ..... 104/1 R, 261, 262, 263, 104/272, 273; 105/7, 177; 254/423; 180/8.1, 8.4, 8.5; 238/10 R

[56] References Cited

U.S. PATENT DOCUMENTS 2,158,352 5/1939 Brown ..... 104/1 R
4,324,186 4/1982 Theurer et al. ..... 104/1 R
4,416,344 11/1983 Nakada ..... 180/8.1

FOREIGN PATENT DOCUMENTS 246212 8/1965 Austria .

*Primary Examiner*—Robert B. Reeves
*Assistant Examiner*—Dennis C. Rodgers
*Attorney, Agent, or Firm*—Kurt Kelman

[57] ABSTRACT

A set-off apparatus for moving a railway carriage transversely off the track includes eight vertically adjustable jacks arranged in four pairs. Two of the jacks of two of the pairs are arranged in each corner of the railway carriage frame, and two pairs of jacks are arranged at each frame end, one of the pairs of jacks being stationary with respect to the frame and the other pair of jacks being displaceable with respect to the frame in a direction extending transversely to the track. A horizontally extending, double-acting cylinder-piston device is arranged for displacing each other pair of jacks transversely whereby the carriage may be transversely set off stepwise while supported in a stilt-like manner.

3 Claims, 11 Drawing Figures

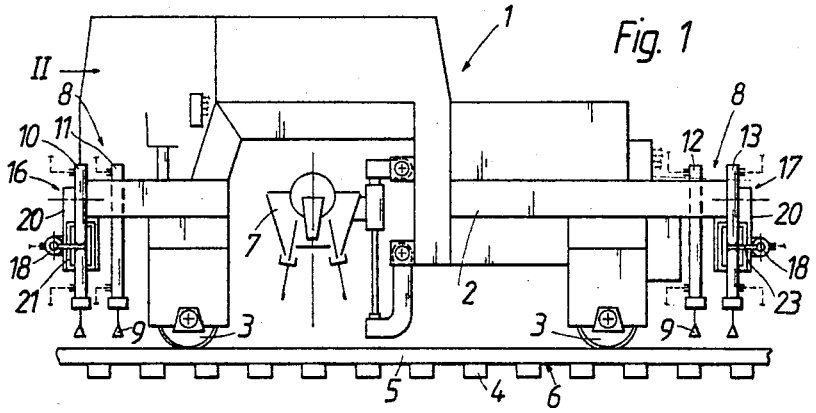
Fig. 1
Fig. 2
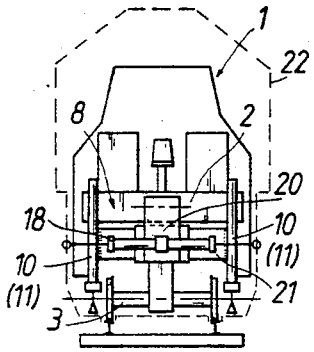
Fig. 3
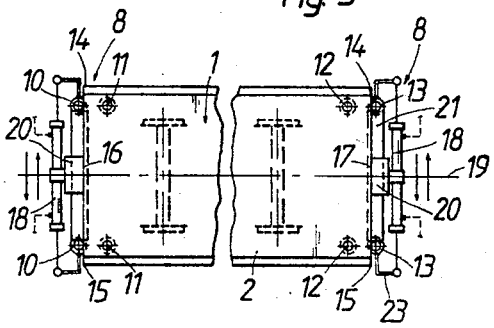
Fig. 4
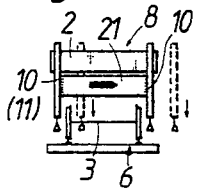
Fig. 5
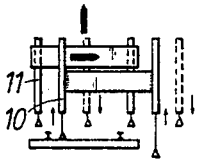
Fig. 6
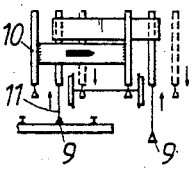
Fig. 7
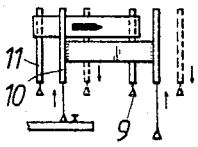
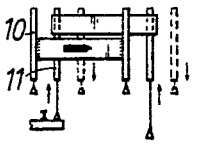
Fig. 8
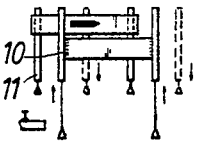
Fig. 9
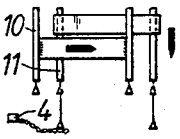
Fig. 10
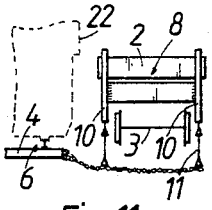
Fig. 11

RAILWAY CARRIAGE WITH SET-OFF APPARATUS

The present invention relates to a railway carriage, particularly a track maintenance work car, comprising a frame having four corners at respective ends of the frame, two undercarriages supporting the frame for mobility on a track and a set-off apparatus for moving the carriage transversely off the track.

U.S. Pat. No. 4,324,186, dated Apr. 13, 1982, discloses such a railway carriage wherein the set-off apparatus is mounted on the underside of the frame between the undercarriages. This apparatus comprises an auxiliary track extending transversely to the carriage and having two rails for supporting the undercarriages. Each auxiliary track rail consists of two rail sections pivotally connected to each other, one of the rail sections being pivotal into a vertical position. Struts interconnect the two rails and a rack-and-pinion drive is provided for transversely moving the carriage on the undercarriages along the auxiliary track. Power drives are required for pivoting the rail sections from their vertical rest positions into their horizontal working positions and supports are required for supporting the ends of these rail sections in their working positions. This set-off apparatus can be used only for light work cars and its operation requires additional personnel for setting up the auxiliary set-off track, for transversely moving the carriage thereon and for returning the set-off track into its rest position.

Austrian Pat. No. 246,212, published Aug. 15, 1965, discloses a set-off apparatus for a track maintenance work car comprising three jacks at each end of the car frame. The centrally positioned jack at each end is stationary while the two outer jacks at each end are transversely pivotal. Operating jacks are linked to the two pivotal jacks for pivoting the same in a controlled manner.

It is the primary object of this invention to provide a set-off apparatus of simple structure and which may be centrally operated.

The above and other objects are accomplished according to the invention with a set-off apparatus which includes at least eight vertically adjustable jacks arranged in four pairs. Two of the jacks of two of the pairs are arranged in each one of the frame corners, and two of said pairs of jacks are arranged at each of said frame ends, one of said pairs of jacks being stationary with respect to the frame and the other pair of jacks being displaceable with respect to the frame in a direction extending transversely to the track, and a horizontally extending, double-acting cylinder-piston device is connected to the jacks of the other pair for displacing each other pair of jacks transversely whereby the carriage may be transversely set off stepwise while supported in a stilt-like manner.

This arrangement enables the carriage to be transversely set off the track from the operator's seat on the carriage simply by operating the respective jacks and does not require auxiliary power drives and support means. In addition, this array of pairs of jacks provides an exceptionally stable structure capable of supporting heavy machines without any problem. The carriage frame between the pairs of jacks in the end regions of the frame remains free to accommodate track maintenance work tools. The set-off apparatus and its control is relatively cheap to build and existing railway carriages may be readily retrofitted with such apparatus. In a stepwise set-off operation effected by displacing one of the pairs of jacks with respect to the other pair, there is no danger of tipping the carriage over so that the operation may be relatively safely carried out even on soft ground. Furthermore, this set-off apparatus has the advantage that the pairs of jacks do not project laterally beyond the track so that the set-off operation may be rapidly effected without requiring complex preparations.

The above and other objects, advantages and features of the present invention will become more apparent from the following detailed description of a now preferred embodiment thereof, taken in conjunction with the accompanying schematic drawing wherein FIG. 1 is a side elevational view of a track tamper incorporating the set-off apparatus of this invention;

FIG. 2 is a reduced front view of the track tamper seen in the direction of arrow II of FIG. 1;

FIG. 3 is a reduced fragmentary top view of the track tamper; and

FIGS. 4 to 11 diagrammatically illustrate the movements executed by the set-off apparatus during a set-off operation.

Referring now to the drawing and first to FIG. 1, there is shown railway carriage 1 constituting a track tamper and comprising frame 2 having four corners 14, 15 at respective ends 16, 17 of the frame. Two undercarriages 3, 3 support frame 2 for mobility on track 6 consisting of rails 5 fastened to ties 4. The railway carriage frame has an upwardly recessed portion between the undercarriages, which houses vertically adjustable track tamping head 7. The railway carriage further comprises set-off apparatus 8 for moving the carriage transversely off track 6.

The illustrated set-off apparatus includes eight vertically adjustable jacks arranged in four pairs, i.e. pairs of jacks 10, 11, 12 and 13. Each jack is comprised of a cylinder mounted on carriage frame 2 and a pressure fluid operated piston slidable in the cylinder, a piston rod extending downwardly from the piston and projecting from a lower end thereof, the free end of the piston rod carrying foot or support pad 9 which may be engaged with the upper surface of a respective track tie 4 or with the ballast bed whereon the track rests. Two jacks 10, 11 and 12, 13 of two pairs are arranged in each frame corner 14, 15 and two pairs of jacks 10, 11 and 12, 13 are arranged at each frame end 16, 17. One pair of jacks 11, 12 is stationary with respect to frame 2 and the other pair of jacks 10, 13 is displaceable with respect to the frame in a direction extending transversely to the track. Horizontally extending, double-acting cylinder-piston device 18 is linked to each pair of jacks 10, 13 for displacing the same transversely whereby the railway carriage may be transversely set off stepwise while supported in a stilt-like manner.

In the preferred embodiment illustrated herein, the transversely displaceable pairs of jacks 10, 13 are arranged on frame 2 at the end faces thereof while the stationary pairs of jacks 11, 12 are arranged on the frame immediately adjacent the transversely displaceable pairs of jacks, respectively behind and in front of the displaceable pairs of jacks, the two stationary pairs of jacks being arranged on the frame between the two transversely displaceable pairs of jacks. This enables the stationary jacks to be solidly affixed to frame 2 while the adjacent pairs of jacks may be displaced without hindrance over a displacement path of considerable length.

In this preferred embodiment, crossbeam 21 connects jacks 10, 13 of each transversely displaceable pair of jacks and a respective end of double-acting cylinder-piston device 18 is linked to each jack of the displaceable pair of jacks, the piston rods of device 18 being linked to bracket 23 affixed to each cylinder of jacks 10 and 13. Guide 20 is substantially centrally mounted at each frame end and transversely displaceably receives and guides the crossbeam. The cylinder of device 18 is affixed to frame 2, being mounted in a bracket on guide 20. This provides a simple but robust mounting of the two jacks of the displaceable pairs of jacks and permits the displacement to be simply controlled by the operation of double-acting cylinder-piston devices 18. The transverse guidance of connecting crossbeam 21 enables the frame to be displaced by operation of devices 18 even when jacks 10, 13 are lowered.

As shown in FIG. 3, the set-off apparatus is symmetrical with respect to longitudinal track axis 19. As indicated in broken lines 22 in FIG. 2, when set-off apparatus 8 is in its rest position, it is located fully within the profile of track 6 and support pads 9 of the jacks are raised out of engagement with the ballast bed or the ties.

The operation of set-off apparatus 8 will be described in detail in connection with FIGS. 4 to 11. For a better understanding, reference will be made only to the relative displacement of the pair of jacks 10 with respect to the pair of jacks 11, the displacement of the rear pair of jacks 13 with respect to pair of jacks 12 proceeding in an identical manner.

FIG. 4 shows the set-off apparatus in a transitional position from the rest position indicated in full lines to a first transverse displacement position indicated in broken lines, the direction of displacement being shown by the heavy horizontal arrow. For this purpose, double-acting device 18 is operated to move the pair of jacks 10 in the indicated displacement direction. As shown in FIG. 5, the support pads of jacks 10 are now lowered into engagement with an underlying tie and/or the ballast bed until undercarriages 3 are lifted off track 6 in the direction indicated by the heavy vertical arrow. Device 18 is then again actuated to displace the carriage 1 transversely in the direction of the heavy horizontal arrow to the position indicated in broken lines in FIG. 5, the carriage being supported on jacks 10 and 13 acting like stilts during this displacement.

After this first step in transversely setting off carriage 1, support pads 9 of stationary jacks 11 are lowered into supporting engagement with the underlying tie and/or the ground, as shown in FIG. 6, while jacks 10 are raised and transversely displaced into the next transitional position indicated in broken lines. In this position (FIG. 7), the support pads of jacks 10 are lowered again and the support pads of jacks 11 are lifted. The pair of jacks 10 is then again displaced, as shown in FIG. 8, and lowered into position for support of the carriage while jacks 11 are raised (FIG. 9), and this sequence of operations is repeated until the position in FIG. 10 has been reached. In this final set-off position laterally adjacent track 6, the pair of jacks 10 is transversely displaced half the displacement path of the previous displacements to be in alignment with jacks 11 and carriage frame 2 is slightly lowered. This set-off rest position of the carriage is illustrated in FIG. 11 which shows the carriage to have been displaced entirely out of profile 22 of track 6 so as to enable passing train traffic to proceed unhindered. When it is desired to use the carriage again for track maintenance work, the steps in the above-outlined procedure are reversed until the undercarriages 3 run on track 6 again.

What is claimed is:

1. A railway carriage comprising a frame having four corners at respective ends of the frame, two undercarriages supporting the frame for mobility on a track and a set-off apparatus for moving the carriage transversely off the track, the set-off apparatus including (a) at least eight vertically adjustable jacks arranged in four pairs, (1) two of the jacks of two of the pairs being arranged in each one of the frame corners, and (2) two of said pairs of jacks being arranged at each of said frame ends, one of said pairs of jacks being stationary with respect to the frame and the other pair of jacks being displaceable with respect to the frame in a direction extending transversely to the track, and (b) a horizontally extending, double-acting cylinder-piston device for displacing each other pair of jacks transversely whereby the carriage may be transversely set off stepwise while supported in a stilt-like manner.

2. The railway carriage of claim 1, wherein the transversely displaceable pairs of jacks are arranged on the frame at the end faces thereof while the stationary pairs of jacks are arranged on the frame immediately adjacent the transversely displaceable pairs of jacks, the two stationary pairs of jacks being arranged on the frame between the two transversely displaceable pairs of jacks.

3. The railway carriage of claim 1, further comprising a crossbeam connecting the jacks of each transversely displaceable pair of jacks, a respective end of the double-acting cylinder-piston device being linked to each jack of the displaceable pair of jacks, and a guide substantially centrally mounted at each frame end and transversely displaceably receiving and guiding the crossbeam.

* * * * *